US011433392B2

(12) United States Patent
Meng et al.

(10) Patent No.: US 11,433,392 B2
(45) Date of Patent: Sep. 6, 2022

(54) MICROFLUIDIC CHIP, APPARATUS, SYSTEM, AND CONTROL AND PREPARATION METHOD THEREFOR

(71) Applicant: SHENZHEN INSTITUTES OF ADVANCED TECHNOLOGY, Shenzhen (CN)

(72) Inventors: Long Meng, Shenzhen (CN); Hairong Zheng, Shenzhen (CN); Kaiyue Wang, Shenzhen (CN); Wei Zhou, Shenzhen (CN); Lili Niu, Shenzhen (CN); Xiaowei Huang, Shenzhen (CN)

(73) Assignee: SHENZHEN INSTITUTES OF ADVANCED TECHNOLOGY, Shenzhen (CN)

( * ) Notice: Subject to any disclaimer, the term of this patent is extended or adjusted under 35 U.S.C. 154(b) by 150 days.

(21) Appl. No.: 16/903,415

(22) Filed: Jun. 17, 2020

(65) Prior Publication Data

US 2020/0316585 A1 Oct. 8, 2020

Related U.S. Application Data

(63) Continuation of application No. PCT/CN2018/070070, filed on Jan. 2, 2018.

(30) Foreign Application Priority Data

Dec. 29, 2017 (CN) ..... 201711480468.5

(51) Int. Cl.
*B01L 3/00* (2006.01)

(52) U.S. Cl.
CPC ..... *B01L 3/5027* (2013.01); *B01L 3/50851* (2013.01); *B01L 2300/0645* (2013.01); *B01L 2300/12* (2013.01); *B01L 2400/0496* (2013.01)

(58) Field of Classification Search
CPC ..... B01L 3/5027; B01L 3/502784; B01L 3/502792; B01L 7/00; B01L 7/52;
(Continued)

(56) References Cited

U.S. PATENT DOCUMENTS

2002/0137196 A1 9/2002 Miles et al.
2003/0113997 A1 6/2003 Roberts
(Continued)

FOREIGN PATENT DOCUMENTS

CN 101236299 A 8/2008
CN 101652643 A 2/2010
(Continued)

OTHER PUBLICATIONS

International Search Report issued in corresponding international application No. PCT/CN2018/070070, dated Sep. 25, 2018(6 pages).
(Continued)

*Primary Examiner* — Jill A Warden
*Assistant Examiner* — Dwayne K Handy

(57) ABSTRACT

A microfluidic chip (100), an apparatus, a system, and a control and preparation method therefor. The method comprises: a substrate (101), and an electrode layer (102) and a functional layer (103) sequentially formed on the substrate (101), said electrode layer (102) comprising a plurality of electrode groups (1021) arranged in an array, the electrode groups (1021) being used for converting electrical signals into acoustic signals when an electrode group is activated, and transmitting the acoustic signals to the functional layer (103); and the functional layer (103) being used for carrying a sample to be tested, and for absorbing the acoustic wave signals emitted by the activated electrode group (1021) and converting same into thermal energy for heating the sample to be tested that is carried at the position corresponding to the activated electrode group (1021).

16 Claims, 7 Drawing Sheets

(58) Field of Classification Search
CPC ..... B01L 2400/0433; B01L 2400/0436; B01L 3/50851; B01L 2400/496
See application file for complete search history.

(56) References Cited

U.S. PATENT DOCUMENTS

| | | | | |
|---|---|---|---|---|
| 2010/0018596 | A1 | 1/2010 | Lee | |
| 2010/0139377 | A1* | 6/2010 | Huang | G01N 15/1404 73/61.75 |
| 2013/0330247 | A1* | 12/2013 | Wilson | G01N 29/222 422/504 |

FOREIGN PATENT DOCUMENTS

| | | | |
|---|---|---|---|
| CN | 102036750 | A | 4/2011 |
| CN | 202309662 | U | 7/2012 |
| CN | 102641759 | A | 8/2012 |
| CN | 102896007 | A | 1/2013 |
| CN | 103008038 | A | 4/2013 |
| CN | 203470015 | U | 3/2014 |
| CN | 106824315 | A | 6/2017 |

OTHER PUBLICATIONS

Written Opinion of the international Searching Authority for No. PCT/CN2018/070070.
First Office Action from China patent office in a counterpart Chinese patent Application 201711480468.5, dated Dec. 4, 2019 (8 pages).

* cited by examiner

MICROFLUIDIC CHIP, APPARATUS, SYSTEM, AND CONTROL AND PREPARATION METHOD THEREFOR

CROSS-REFERENCE TO RELATED APPLICATIONS

The present application is a continuation-application of International (PCT) Patent Application No. PCT/CN2018/070070, filed on Jan. 2, 2018, which claims foreign priorities of Chinese Patent Application No, 201711480468.5, filed on Dec. 29, 2017, the entire contents of which are hereby incorporated by reference.

TECHNICAL FIELD

This application relates to the field of microscale heating technologies, and in particular, to a microfluidic chip, apparatus and system, and a control and preparation method therefor.

BACKGROUND

The microfluidic chip technology integrates basic operation units such as sample preparation, reaction, separation, and detection in biological, chemical, and medical analysis processes into a micron-sized chip to automatically complete the entire analysis process. Due to its features of controllable liquid flow, very little sample and reagent consumption, and analysis speed improvement by dozens or hundreds of times, this technology has great potential in the fields of biology, chemistry, medicine, etc., and has received extensive attention from scientific research institutions in and out of China.

In recent years, as microfluidic technologies develop, the research on microscale heating technologies has attracted the attention of academia. A microscale heating method has the advantages of low heating power, fast response, small heat loss, easy integration with other microelectronic devices, etc. It has been used, to varying extents, in fields including nucleic acid amplification, thermophoresis, particle manipulation, cell culture, etc.

At present, most of the existing microscale heating technologies integrate metal blocks or films as heating electrodes into a chip. By heating the metal blocks or films, different positions in the chip are heated. Common heating solutions mainly include the following: (1) metal block heating method; (2) indium tin oxide film heating method; (3) infrared heat source heating method.

Metal block heating method: Metal heaters are usually located in opaque channels to quickly and accurately control temperatures of liquid samples. However, because this method is optically opaque and easy to electrolyze in liquid samples, it is usually necessary to use relatively expensive metals such as platinum and gold and other precious metals. Consequently, the heating status is not easily observed and costs are high. Indium tin oxide film heating method: In this technology, microfluidic channels are usually etched on the glass, and the transparent indium tin oxide film is integrated as an electrode into a microfluidic chip, so as to improve the visibility of internal channels for easy observation. However, the heating region in this method is fixed and cannot be changed. Infrared heat source heating method: In this technology, tungsten and other materials are used as the infrared radiation source, and the far-infrared source is used for heating. The energy efficiency of this radiation heating is not high, and optical devices such as lens filters are required. In addition, infrared rays affect experimental observation.

In conclusion, the heating efficiency of the existing microscale heating chip is not high, costs are high, the heating source region is fixed, and the heating process is not easily observed.

SUMMARY

In view of the above, an objective of this application is to provide a microfluidic chip, apparatus and system, and a control and preparation method therefor, so as to provide a microfluidic chip that features high energy conversion efficiency, fast heating, and implementation of heating in a specific region.

According to a first aspect, an embodiment of this application provides a microfluidic chip, including: a substrate, and an electrode layer and a functional layer sequentially formed on the substrate, where the electrode layer includes multiple electrode groups arranged in an array;

The electrode group is configured to: When being activated, convert an electrical signal into an acoustic signal, and transmit the acoustic signal to the functional layer; and the functional layer is configured to: carry a sample to be tested; absorb the acoustic signal emitted by the activated electrode group and convert the acoustic signal into thermal energy; and heat the sample to be tested that is carried at a position corresponding to the activated electrode group.

With reference to the first aspect, in a first possible implementation of the first aspect according to the embodiment of this application, the electrode group includes two interdigital electrodes arranged in interdigital fingers, interdigital widths of the two interdigital electrodes of the same electrode group are equal, gaps between adjacent interdigital fingers are equal, and the interdigital width is equal to the gap.

With reference to the first possible implementation of the first aspect, in a second possible implementation of the first aspect according to the embodiment of this application, interdigital electrodes of each of the multiple electrode groups arranged in an array have equal interdigital widths.

With reference to the first possible implementation of the first aspect, in a third possible implementation of the first aspect according to the embodiment of this application, among the multiple electrode groups arranged in an array, interdigital widths of interdigital electrodes in the same column of electrode groups change progressively in a column direction, and interdigital widths of interdigital electrodes in the same row of electrode groups change progressively in a row direction.

With reference to the first aspect, in a fourth possible implementation of the first aspect according to the embodiment of this application, the functional layer includes a first functional layer and a second functional layer, the first functional layer is located above the electrode layer and is bonded to the substrate, the second functional layer is located above the first functional layer, and a channel for carrying the sample to be tested is disposed between the first functional layer and the second functional layer.

With reference to the first aspect, in a fifth possible implementation of the first aspect according to the embodiment of this application, the functional layer is made from polydimethylsiloxane.

With reference to the first aspect, in a sixth possible implementation of the first aspect according to the embodiment of this application, the substrate is made from any material from lithium niobate, zinc oxide, or aluminum oxide.

With reference to the sixth possible implementation of the first aspect, in a seventh possible implementation of the first aspect according to the embodiment of this application, the substrate is made from 128° YX double-sided polished lithium niobate.

According to a second aspect, an embodiment of this application provides a microfluidic apparatus, where the apparatus is configured to control the microfluidic chip according to any one of the first aspect to the seventh possible implementation of the first aspect, and includes a controller and a signal generator, where the controller is connected to the signal generator;

The controller is configured to control the signal generator to generate an electrical signal based on a set frequency; and The signal generator is configured to transmit the generated electrical signal to an electrode group for activation when connected to the electrode group, so that the activated electrode group generates an acoustic signal.

With reference to the second aspect, in a first possible implementation of the second aspect according to the embodiment of this application, the apparatus further includes a frequency divider, where the frequency divider includes a signal input interface and multiple signal output interfaces, the frequency divider is connected to the signal generator through the signal input interface, and the multiple signal output interfaces are configured to connect to different electrode groups respectively; and The frequency divider is configured to divide the electrical signal generated by the signal generator into electrical signals of different frequencies, and when connected to different electrode groups, transmit the electrical signals of different frequencies through the signal output interfaces to the electrode groups for activation.

According to a third aspect, an embodiment of this application provides a microfluidic system, where system includes the microfluidic chip according to any one of the first aspect to the seventh possible implementation of the first aspect, and the microfluidic apparatus according to the second aspect or the first possible implementation of the second aspect.

According to a fourth aspect, an embodiment of this application provides a microfluidic chip control method, where the method is used to control the microfluidic apparatus according to the second aspect or the first possible implementation of the second aspect, and includes:

Controlling, by the controller, the signal generator to generate an electrical signal based on a set frequency; and Controlling, by the controller, the signal generator to transmit the generated electrical signal to the electrode group for activation when the signal generator is connected to the electrode group, so that the activated electrode group generates an acoustic signal.

With reference to the fourth aspect, in a first possible implementation of the fourth aspect according to the embodiment of this application, the method further includes:

Transmitting, by the controller, the electrical signal to the frequency divider by using the signal generator; and Dividing, by the controller, the electrical signal into electrical signals of different frequencies by using the frequency divider, and transmitting the electrical signals to the electrode groups for activation.

According to a fifth aspect, an embodiment of this application provides a microfluidic chip preparation method, where the method is used to prepare the microfluidic chip according to any one of the first aspect to the seventh possible implementation of the first aspect, and includes:

Forming a photoresist layer on the substrate;

Performing photoetching on the photoresist layer to form a set pattern arranged in an array on the substrate;

Performing sputtering on the substrate corresponding to the pattern to form an electrode layer, where the formed electrode layer includes multiple electrode groups arranged in an array, so that the electrode group converts an electrical signal into an acoustic signal when activated, and transmits the acoustic signal to the functional layer; and Forming the functional layer on the electrode layer, so that the functional layer carries a sample to be tested, absorbs the acoustic signal emitted by the activated electrode group and converts the acoustic signal into thermal energy, and heats the sample to be tested that is carried at a position corresponding to the activated electrode group.

With reference to the fifth aspect, in a first possible implementation of the fifth aspect according to the embodiment of this application, the performing photoetching on the photoresist layer to form a set pattern arranged in an array on the substrate includes:

Laying a mask on the photoresist layer for exposure, where the mask is the set pattern arranged in an array; and Developing and dissolving a non-transparent region in the photoresist layer when the photoresist layer is exposed, to form the set pattern arranged in an array on the substrate.

Different from the prior art, in this application, an external device transmits an electrical signal to the electrode layer, and the electrode layer converts the electrical signal into an acoustic signal. The acoustic signal can be absorbed by the functional layer to generate thermal energy, and the electrode layer includes multiple electrode groups arranged in an array. As long as some of the multiple electrode groups are activated through separate control, the corresponding functional layer at the position of the activated electrode group can genera thermal energy, thereby heating the sample to be tested. This application provides a microfluidic chip that features high energy conversion efficiency, fast heating, and implementation of heating in a specific region.

To make the foregoing objectives, features, and advantages of this application clearer and more comprehensible, the following provides a detailed description by using preferred embodiments with reference to the accompanying drawings.

BRIEF DESCRIPTION OF DRAWINGS

To describe the technical solutions in the embodiments of this application more clearly, the following briefly describes the accompanying drawings required for the embodiments. It should be understood that, the accompanying drawings show merely some embodiments of this application; and therefore should not be considered a limitation on the scope. A person of ordinary skill in the art may derive other drawings from these accompanying drawings without creative efforts.

Figure 1:
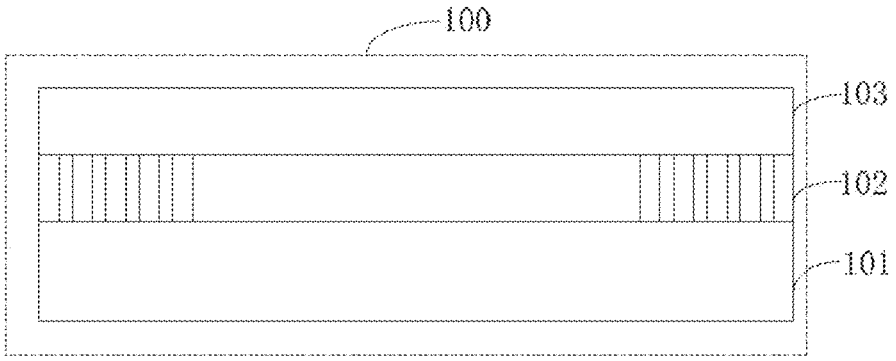
FIG. 1 is a schematic diagram of a cross-sectional structure of a microfluidic chip according to an embodiment of this application.

Reference numerals: 100—microfluidic chip; 101—substrate; 102—electrode layer; 103—functional layer; 1021—electrode group; 1021A—interdigital electrode; 400—microfluidic apparatus; 401—controller; 402—signal generator; 403—frequency divider; 4031—signal input interface; 4032—signal output interface; 104—photoresist layer.

DESCRIPTION OF EMBODIMENTS

To make the objectives, technical solutions, and advantages of the embodiments of this application clearer, the following clearly and comprehensively describes the technical solutions in the embodiments of this application with reference to the accompanying drawings in the embodiments of this application. Clearly, the described embodiments are merely some but not all of the embodiments of this application. Generally, the components of the embodiments of this application that are described and illustrated in the accompanying drawings herein can be arranged and designed in various configurations. Therefore, the following detailed description of the embodiments of this application provided in the accompanying drawings is not intended to limit the claimed scope of this application, but merely represents selected embodiments of this application. All other embodiments obtained by a person skilled in the art based on the embodiments of this application without creative efforts shall fall within the protection scope of this application.

Embodiment 1

Figure 2:
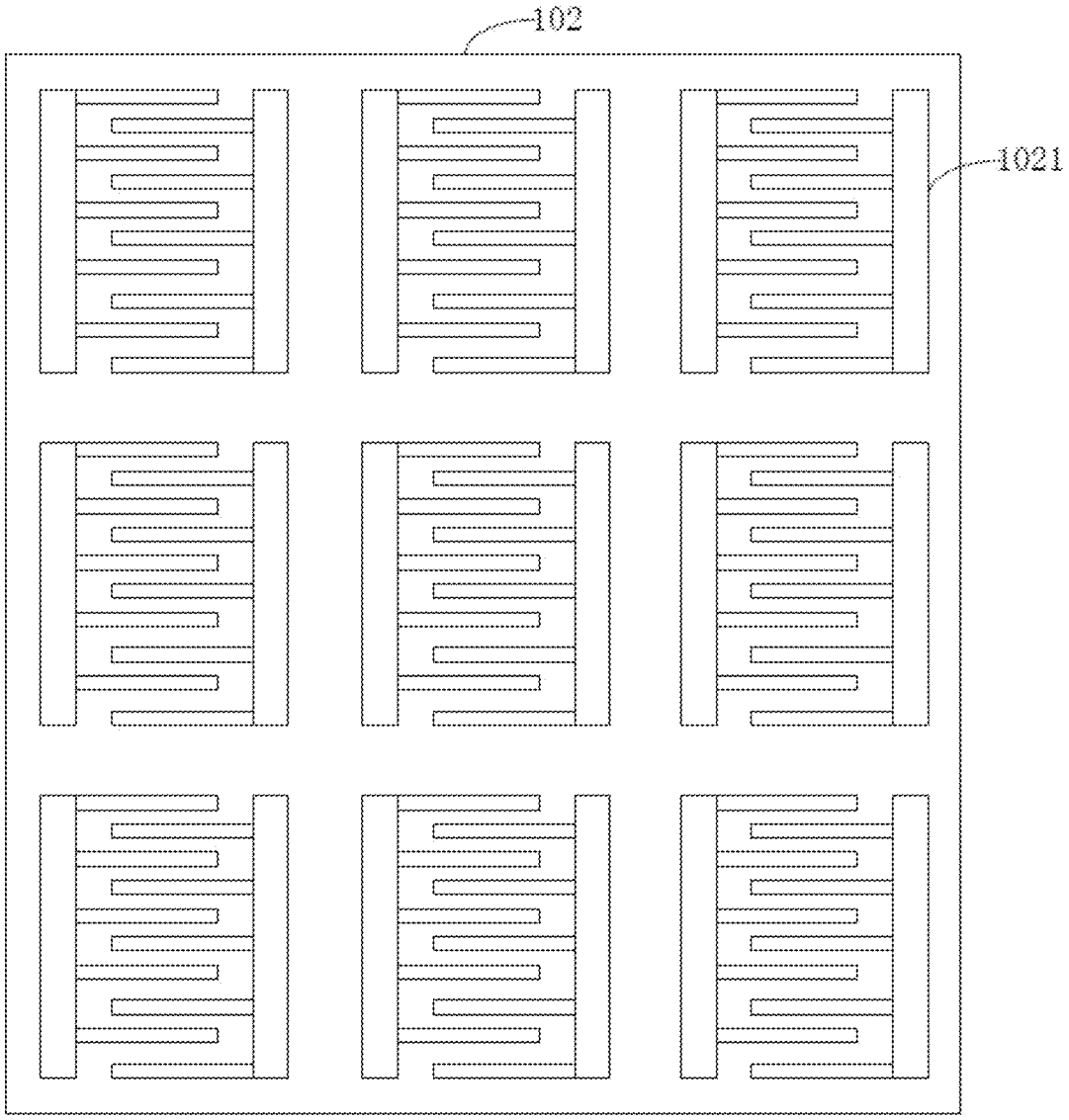
FIG. 2 is a front view of an electrode layer in a microfluidic chip according to an embodiment of this application.

Embodiment 1 of this application provides a microfluidic chip 100. FIG. 1 is a cross-sectional view of the microfluidic chip. The microfluidic chip includes: a substrate 101, and an electrode layer 102 and a functional layer 103 sequentially formed on the substrate 101. The electrode layer 102 includes multiple electrode groups 1021 arranged in an array. The array arrangement is shown in FIG. 2, in which three rows and three columns are used as an example.

The electrode group 1021 is configured to: when being activated, convert an electrical signal into an acoustic signal, and transmit the acoustic signal to the functional layer 103.

Figure 3:
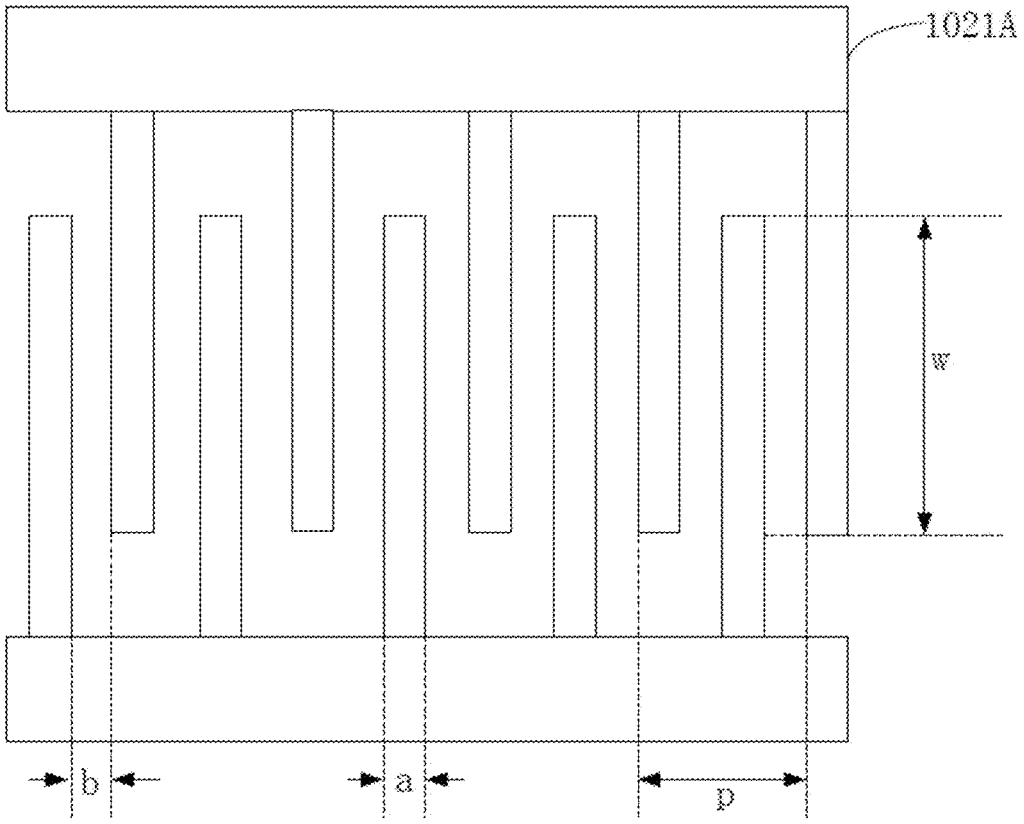
FIG. 3 is a schematic structural diagram of an electrode group according to an embodiment of this application.

As shown in FIG. 3, one electrode group 1021 is used as an example for description. The electrode group 1021 includes two interdigital electrodes 1021A arranged in interdigital fingers, interdigital widths a of the two interdigital electrodes 1021A of the same electrode group 1021 are equal, gaps b between adjacent interdigital fingers are equal, and the interdigital width a is equal to the gap b. In the figure, p represents a period of the electrode group, and w represents an acoustic aperture size when the interdigital electrode converts an electrical signal into an acoustic signal.

A resonant frequency of each electrode group is related to an acoustic velocity and an interdigital width. A formula of the resonant frequency f is as follows:

$f=V_m/M$, where $V_m$ represents the acoustic velocity, and $M=4a=4b$.

Here, an interdigital period $P=2(a+b)$.

Changing the interdigital period indirectly changes the resonant frequency of the electrode group. For a specific input signal frequency, only an electrode group whose resonant frequency corresponds to the input signal frequency can be activated, thereby generating an acoustic signal of the corresponding frequency.

In a preferred embodiment, in the technical solution provided in Embodiment 1 of this application, interdigital electrodes of each of the multiple electrode groups arranged in an array have equal interdigital widths.

If the interdigital electrodes of each electrode group have equal interdigital widths, resonant frequencies of the electrode groups are equal. If electrical signals of the same frequency are used to activate the electrode groups, frequencies of acoustic signals generated by the electrode groups are equal, and electrical signals can be selectively input into some electrode groups. In this way, only the selected electrode groups can generate acoustic signals, the frequencies of the input electrical signals are equal, and therefore the frequencies of the acoustic signals generated by these electrode groups are equal.

In a preferred embodiment, in the technical solution provided in Embodiment 1 of this application, among the multiple electrode groups arranged in an array, interdigital widths of interdigital electrodes in the same column of electrode groups change progressively in a column direction, and interdigital widths of interdigital electrodes in the same row of electrode groups change progressively in a row direction.

It can be seen from the resonant frequency formula that, the resonant frequency of the electrode group is related to the interdigital width of the interdigital electrode, and therefore the resonant frequency of the electrode group can be adjusted by controlling the interdigital width of the interdigital electrode. For example, among the multiple electrode groups arranged in an array, the interdigital widths of the interdigital electrodes in the same column of electrode groups are adjusted to change progressively in a column direction, so that the resonant frequencies of the same column of electrode groups change progressively in the column direction. In this way, when electrical signals of the same frequency are input into the same column of electrode groups, because the resonant frequencies of the column of electrode groups change progressively, amplitudes of the generated acoustic signals also change progressively, and temperatures corresponding to thermal energy generated at the functional layer also change progressively, forming a temperature gradient field. Similarly, the interdigital widths of the interdigital electrodes in the same row of electrode groups are adjusted to change progressively in a row direction, so that the resonant frequencies of the same row of electrode groups change progressively in the row direction.

In this way, for the electrode groups arranged in an array at the electrode layer, the resonant frequencies of electrode groups in the same row are different, and the operating frequencies of electrode groups in the same column are also different. When electrical signals that have different frequencies and that can enable an electrode group to resonate are input into the electrode group, a hotspot array can be formed at the electrode layer. For example, the electrode group of the set pattern is selected to generate resonance, so that the functional layer corresponding to the electrode group forming the set pattern generates thermal energy, and therefore the set pattern can be formed in a thermal imaging device.

The functional layer 103 is configured to: carry a sample to be tested; absorb the acoustic signal emitted by the activated electrode group 1021 and convert the acoustic signal into thermal energy; and heat the sample to be tested that is carried at a position corresponding to the activated electrode group 1021.

The functional layer is made from a viscoelastic material. When an acoustic wave is absorbed by the viscoelastic material, heat can be generated, causing the temperature of the material to rise. Polydimethylsiloxane is a high-molecular organosilicon compound. Research shows that polydimethylsiloxane can absorb more acoustic energy than liquid samples and other materials such as glass or silicon, thereby significantly increasing the temperature, and thus heating the sample placed on polydimethylsilane.

In a preferred embodiment, in the technical solution provided in Embodiment 1 of this application, the functional layer includes a first functional layer and a second functional layer, the first functional layer is located above the electrode layer and is bonded to the substrate, the second functional layer is located above the first functional layer, and a channel for carrying the sample to be tested is disposed between the first functional layer and the second functional layer.

In this application, the acoustic signal generated by the electrode group propagates along the substrate, and is refracted at an interface between the polydimethylsiloxane and the substrate and enters the polydimethylsiloxane sheet. This part of acoustic wave is absorbed by the polydimethylsiloxane to generate heat, causing the temperature of the polydimethylsiloxane material to rise.

In a preferred embodiment, in the technical solution provided in Embodiment 1 of this application, the substrate is made from any material from lithium niobate, zinc oxide, or aluminum oxide. These materials are semi-elastic dielectric materials, and the acoustic waves generated by the electrode group are surface acoustic waves. Surface acoustic waves are elastic waves propagating on a semi-elastic dielectric surface, and their energy is less absorbed by the substrate material. Therefore, the acoustic wave in the microfluidic chip provided in this application features small transmission loss, effectively ensuring the energy conversion efficiency.

In a preferred embodiment, in the technical solution provided in Embodiment 1 of this application, to obtain high electromechanical conversion efficiency between the electrode group and the substrate, the substrate is generally made from 128° YX double-sided polished lithium niobate.

Embodiment 2

Figure 4:
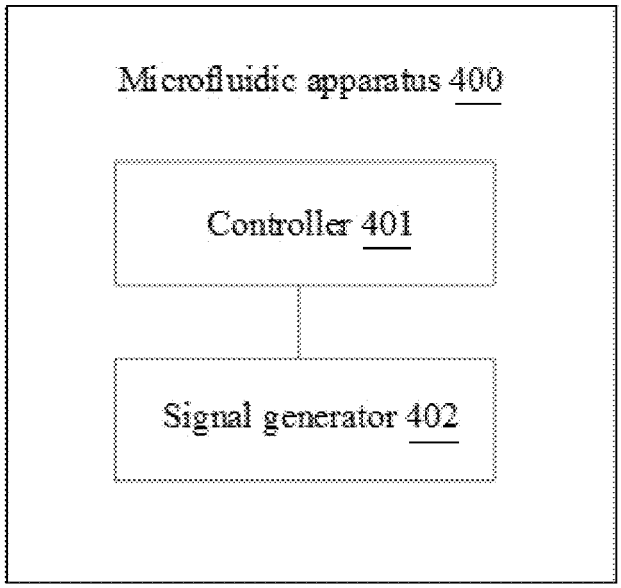
FIG. 4 is a schematic structural diagram of a first microfluidic apparatus according to an embodiment of this application.

Embodiment 2 of this application provides a microfluidic apparatus 400. The microfluidic apparatus 400 is configured to control the microfluidic chip 100 provided in Embodiment 1. As shown in FIG. 4, the microfluidic apparatus 400 includes a controller 401 and a signal generator 402, where the controller 401 is connected to the signal generator 402.

The controller 401 is configured to control the signal generator 402 to generate an electrical signal based on a set frequency.

The signal generator 402 is configured to transmit the generated electrical signal to an electrode group for activation when connected to the electrode group, so that the activated electrode group generates an acoustic signal.

Figure 5:
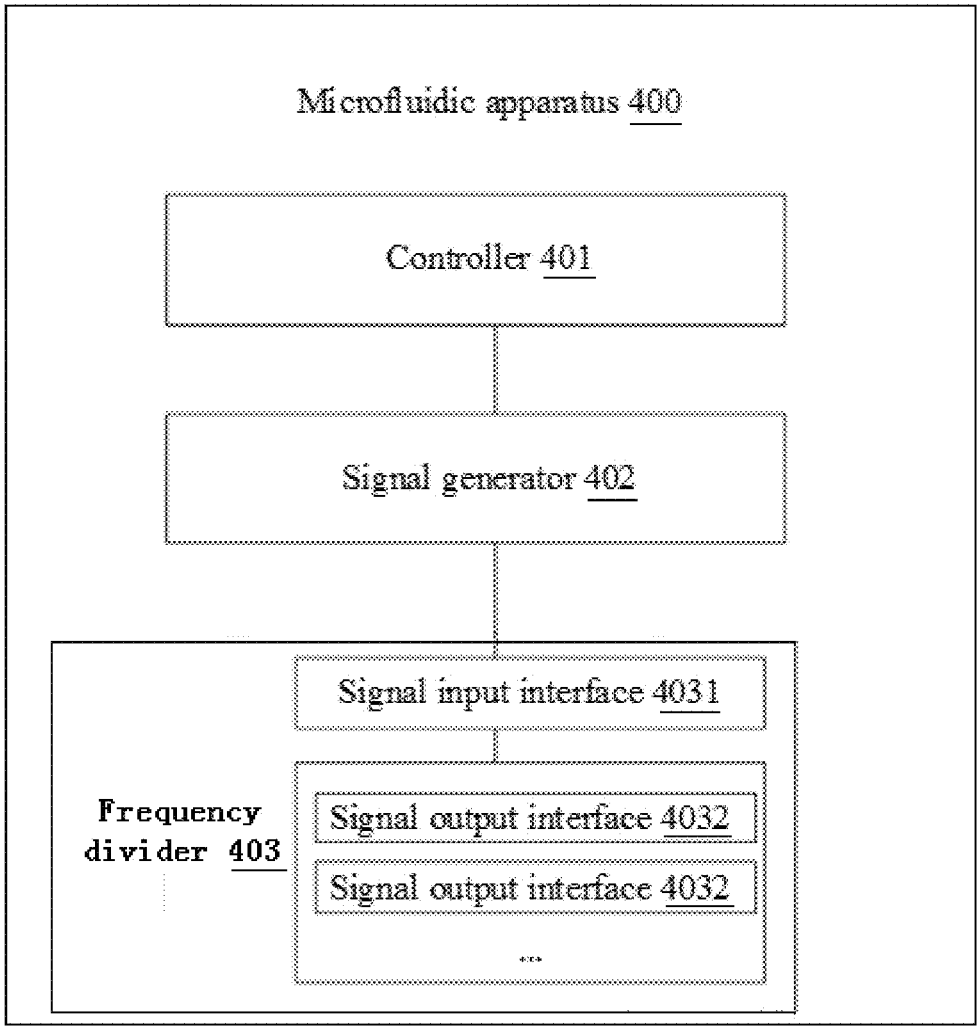
FIG. 5 is a schematic structural diagram of a second microfluidic apparatus according to an embodiment of this application.

In a preferred embodiment, in the technical solution provided in Embodiment 2 of this application, as shown in FIG. 5, the microfluidic apparatus 400 further includes a frequency divider 403, where the frequency divider 403 includes a signal input interface 4031 and multiple signal output interfaces 4032, the frequency divider 403 is connected to the signal generator 402 through the signal input interface 4031, and the multiple signal output interfaces 4032 are configured to connect to different electrode groups.

The frequency divider 403 is configured to divide the electrical signal generated by the signal generator into electrical signals of different frequencies, and when connected to different electrode groups, transmit the electrical signals of different frequencies through the signal output interfaces 4032 to the electrode groups for activation.

The frequency divider can transform, by using a specific circuit structure, the same electrical signal into electrical signals of different frequencies for outputting, so as to concurrently control multiple electrode groups with different resonant frequencies.

Preferably, each signal output interface of the frequency divider 403 is provided with a control switch, and each control switch is connected to the controller 401.

For example, the frequency divider 403 has five signal output interfaces 4032, and the five signal output interfaces 4032 are all provided with control switches, which are respectively denoted as A, B, C, D, and E. These five control switches are all connected to the controller.

The controller 401 is further configured to control on-off of a set control switch, so as to control connection or disconnection of an electrical signal that is output by the signal output interface 4032 corresponding to the set control switch in the frequency divider.

For example, a signal output interface of the frequency divider is connected to an electrode group A in the first row and the first column. A control switch A is disposed on a connecting wire of the signal output interface and the electrode group, and the control switch is connected to the controller. The controller can control the control switch A to be closed or open, so as to control whether to input an electrical signal into the electrode group A.

Embodiment 3

Figure 6:
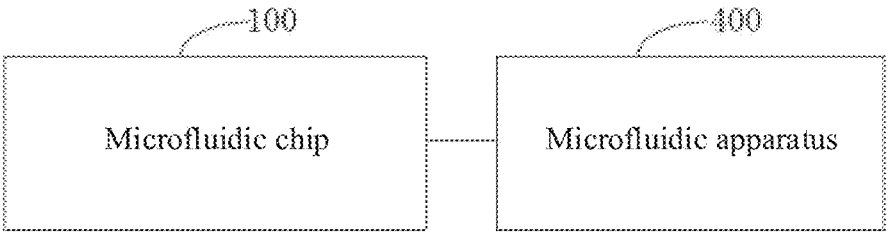
FIG. 6 is a schematic structural diagram of a microfluidic system according to an embodiment of this application.

Embodiment 3 of this application provides a microfluidic system, as shown in FIG. 6, including the microfluidic chip 100 in Embodiment 1 and the microfluidic apparatus 400 in Embodiment 2.

Embodiment 4

Figure 7:
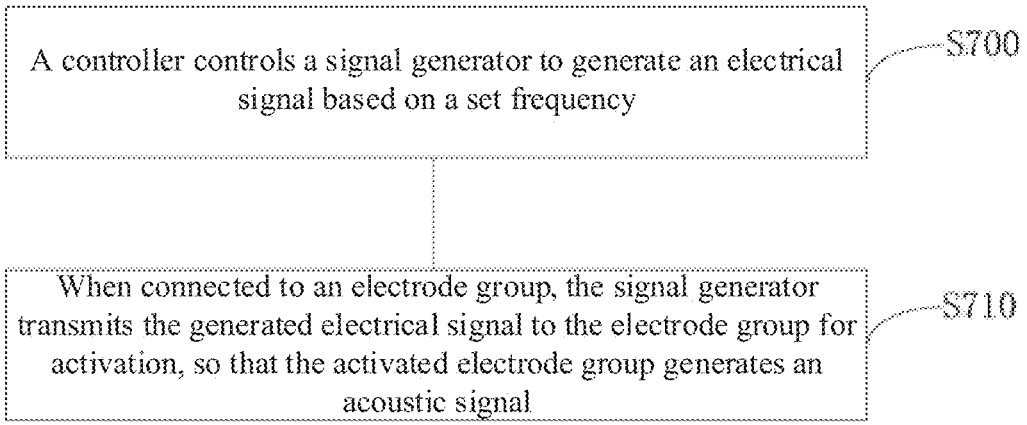
FIG. 7 is a schematic diagram of a first microfluidic chip control method according to an embodiment of this application.

Embodiment 4 of this application provides a microfluidic chip control method, which is used for the microfluidic apparatus in Embodiment 2. A flowchart of this method is shown in FIG. 7, and specific steps are as follows:

S700: A controller controls a signal generator to generate an electrical signal based on a set frequency.

S710: When connected to an electrode group, the signal generator transmits the generated electrical signal to the electrode group for activation, so that the activated electrode group generates an acoustic signal.

Figure 8:
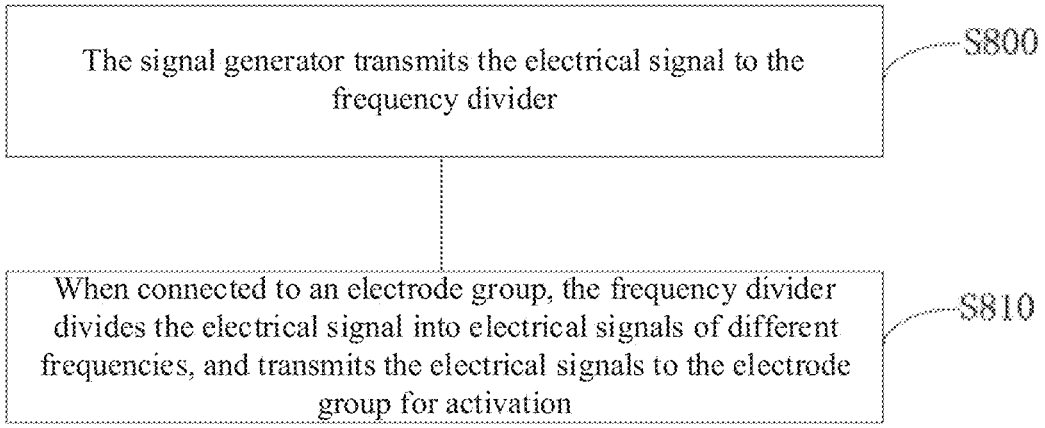
FIG. 8 is a schematic diagram of a second microfluidic chip control method according to an embodiment of this application.

In a preferred embodiment, in the technical solution provided in Embodiment 4 of this application, as shown in FIG. 8, the microfluidic chip control method further includes the following:

S800: The signal generator transmits the electrical signal to a frequency divider.

S810: When connected to an electrode group, the frequency divider divides the electrical signal into electrical signals of different frequencies, and transmits the electrical signals to the electrode group for activation.

Embodiment 5

Figure 9:
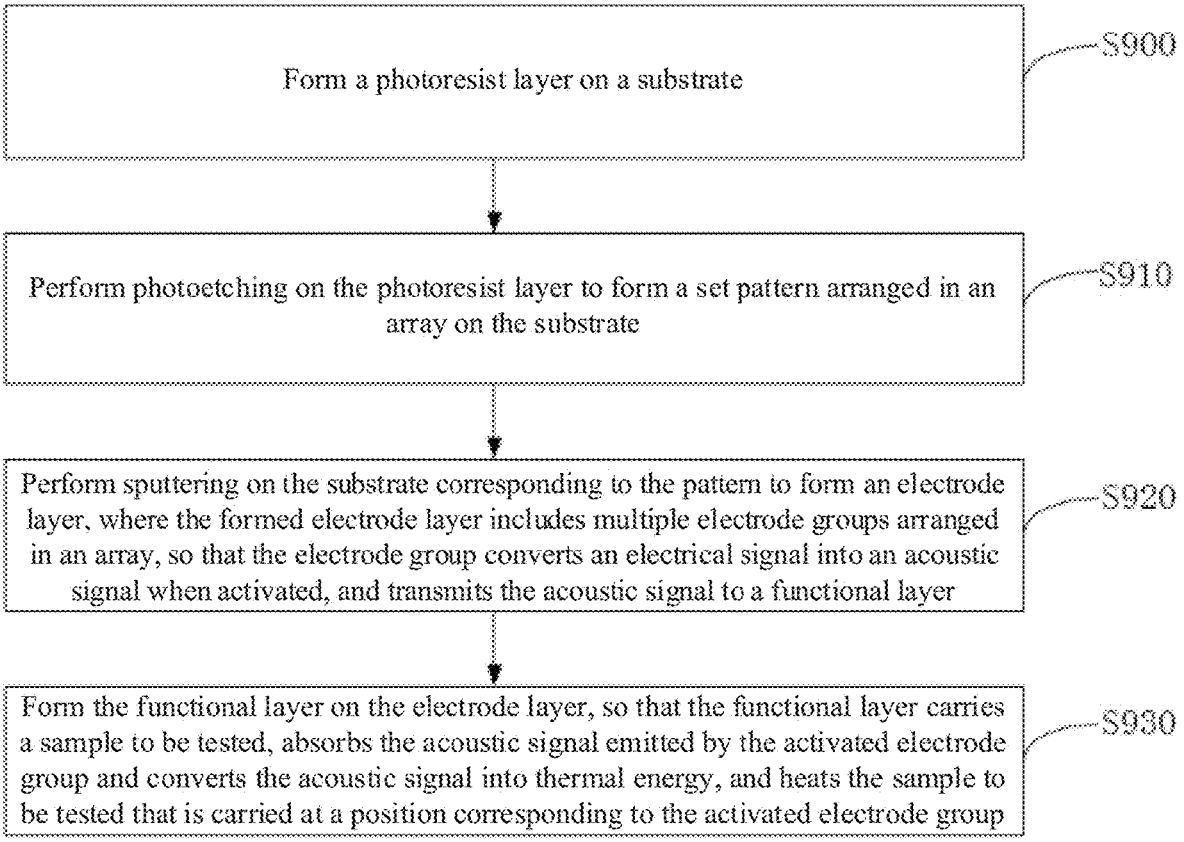
FIG. 9 is a flowchart of a microfluidic chip preparation method according to an embodiment of this application.

Embodiment 5 of this application provides a microfluidic chip preparation method, which is used to prepare the microfluidic chip in Embodiment 1. A flowchart of this method is shown in FIG. 9, and specific steps are as follows:

S900: Form a photoresist layer on a substrate.

Figure 10:
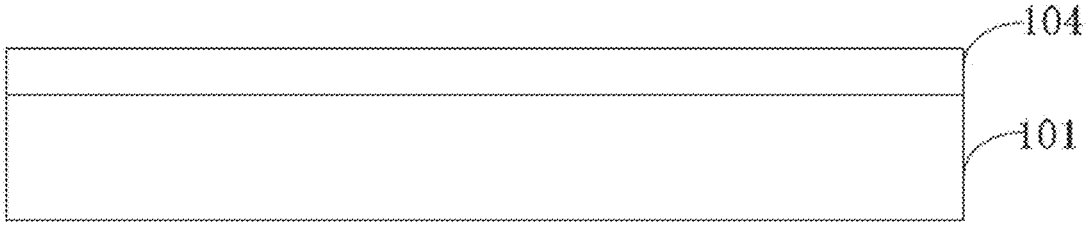
FIG. 10 is a schematic structural diagram after preparation of photoresist on a substrate according to an embodiment of this application.

On a completely clear and clean surface of the substrate, apply the photoresist AZ4620 through spin-coating at 5000 rpm for 30 s, place a product on a 120° C. heating plate for baking for three minutes, and then test the thickness of the photoresist by using a step profiler. The thickness of the photoresist is about 5 μm. The obtained cross-sectional view is shown in FIG. 10, including a substrate 101 and a photoresist layer 104.

S910: Perform photoetching on the photoresist layer to form a set pattern arranged in an array on the substrate.

Figure 11:
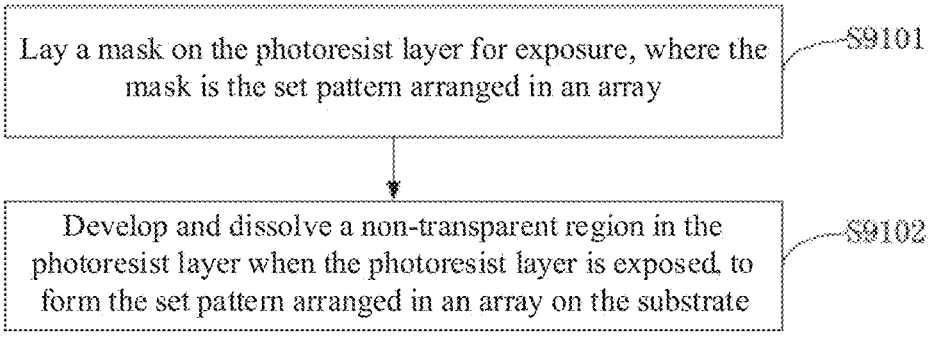
FIG. 11 is a flowchart of a method for forming a set pattern arranged in an array on a substrate according to an embodiment of this application.

In a preferred embodiment, in the technical solution provided in Embodiment 5 of this application, S910 specifically includes the following steps, and a flowchart is shown in FIG. 11.

S9101: Lay a mask on the photoresist layer for exposure, where the mask is the set pattern arranged in an array.

The mask here may be a film, and the film with the set pattern is overlaid on the photoresist layer formed in FIG. 10 for exposure, and a transparent part is cured.

S9102: Develop and dissolve a non-transparent region in the photoresist layer when the photoresist layer is exposed, to form the set pattern arranged in an array on the substrate.

Figure 12:
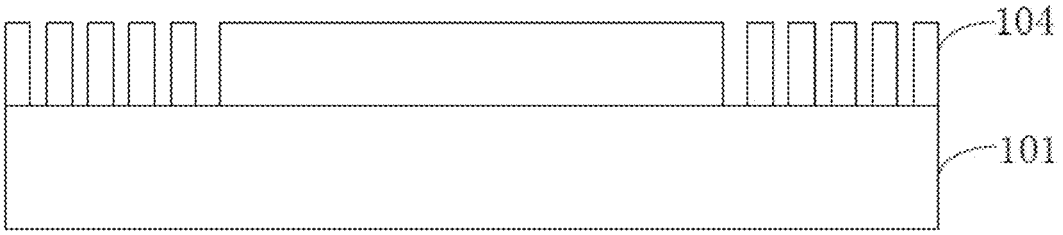
FIG. 12 is a schematic structural diagram after development through exposure of photoresist according to an embodiment of this application.

Use AZ400 to develop and dissolve a non-cured part in the non-transparent region, and then bake the non-cured part on a 150° C. heating plate for 10 minutes. The formed cross-sectional view is shown in FIG. 12.

S920: Perform sputtering on the substrate corresponding to the pattern to form an electrode layer, where the formed electrode layer includes multiple electrode groups arranged in an array, so that the electrode group converts an electrical signal into an acoustic signal when activated, and transmits the acoustic signal to a functional layer.

Figure 13:
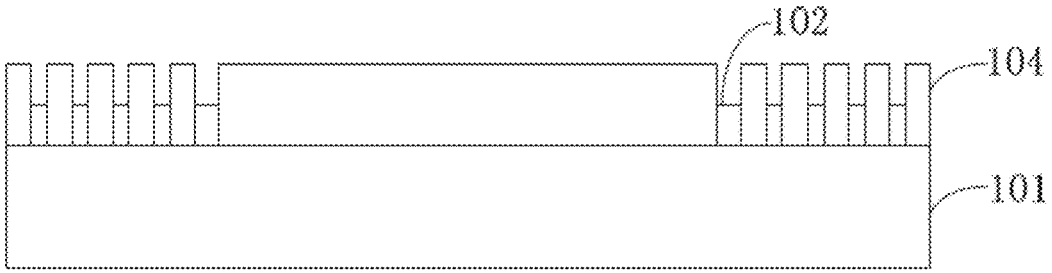
FIG. 13 is a schematic structural diagram after formation of an electrode group through sputtering on a substrate according to an embodiment of this application.

Perform magnetron sputtering on the substrate after S9102 to form a metal layer with a thickness of about 200 nm. The metal layer is the electrode layer 102, as shown in FIG. 13.

Figure 14:
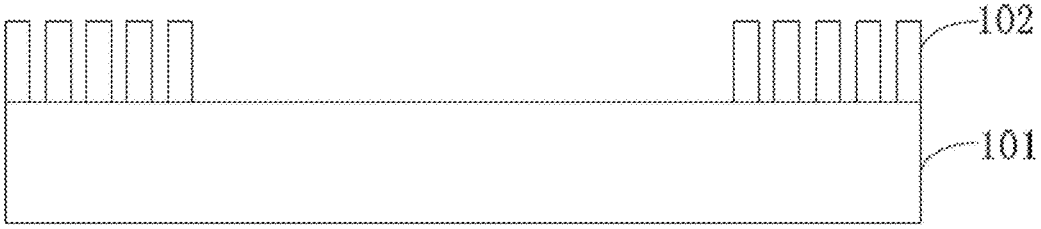
FIG. 14 is a schematic structural diagram after removal of unnecessary photoresist upon formation of an electrode group according to an embodiment of this application.

Place the previously obtained chip in an acetone solution, and peel off the non-photoetched photoresist through ultrasonic vibration of an ultrasonic cleaning machine. The formed cross-sectional view is shown in FIG. 14.

S930: Form the functional layer on the electrode layer, so that the functional layer carries a sample to be tested, absorbs the acoustic signal emitted by the activated electrode group and converts the acoustic signal into thermal energy, and heats the sample to be tested that is carried at a position corresponding to the activated electrode group.

After the functional layer is formed on the electrode layer, the obtained cross-sectional view is shown in FIG. 1, that is, the microfluidic chip 100 in Embodiment 1 is obtained.

Figure 15:
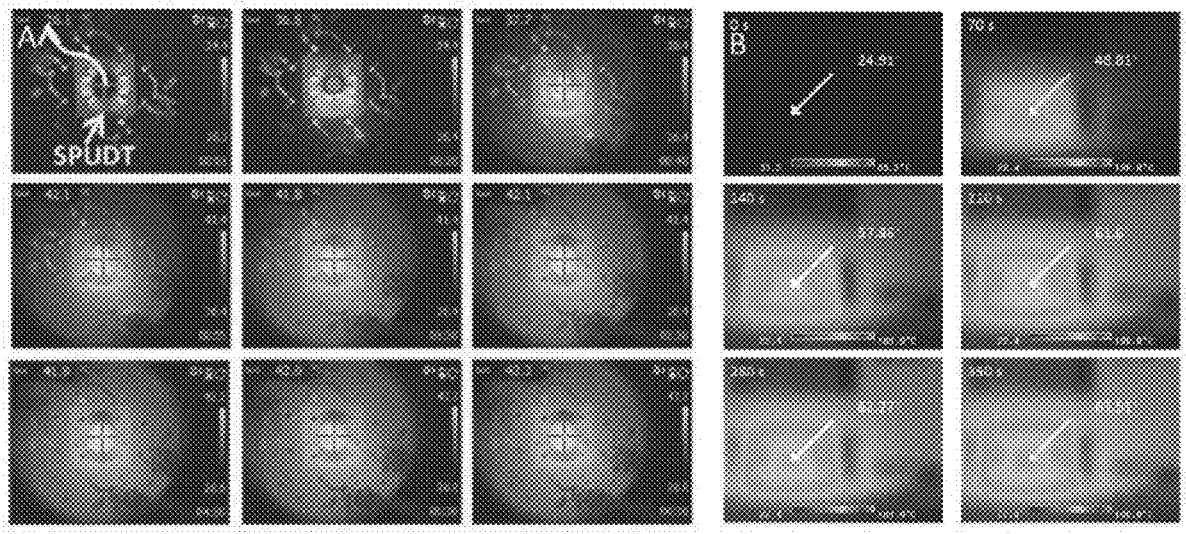
FIG. 15 is a schematic diagram of an experimental result of heating of a microfluidic chip according to an embodiment of this application.

In addition, during the rapid temperature rise and temperature control of the microfluidic chip using surface acoustic waves, the applicant obtained the experimental result shown in FIG. 15. In FIG. 15, Figure A shows the change and spatial distribution of fluid temperature in an annular channel of polydimethylsiloxane of a unit unidirectional interdigital electrode group, and Figure B shows the change and spatial distribution of fluid temperature in a channel of polydimethylsiloxane of a straight interdigital electrode group.

Figure 16:
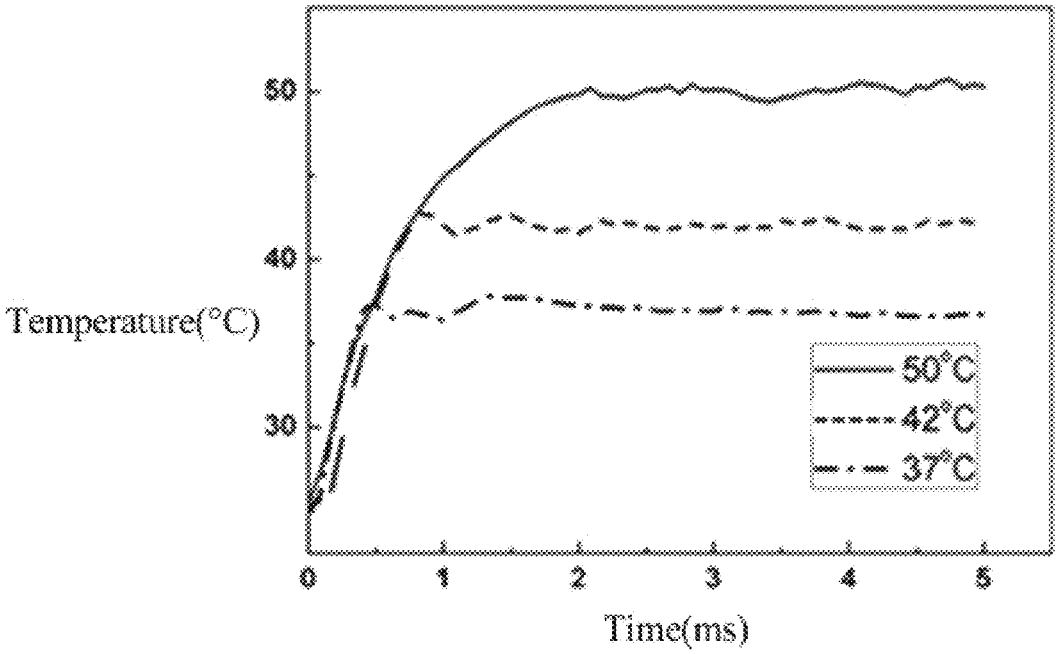
FIG. 16 is a schematic diagram of an experimental result of heating of another microfluidic chip according to an embodiment of this application.

The experimental result shows that, by adjusting an input pulse length and frequency, the fluid temperature in the channel of polydimethylsiloxane can be accurately increased and maintained at the desired temperature, which are 37° C., 42° C., and 50° C. respectively, as shown in FIG. 16.

Different from the prior art, in this application, an external device transmits an electrical signal to the electrode layer, and the electrode layer converts the electrical signal into an acoustic signal. The acoustic signal can be absorbed by the functional layer to generate thermal energy, and the electrode layer includes multiple electrode groups arranged in an array. As long as some of the multiple electrode groups are activated through separate control, the corresponding functional layer at the position of the activated electrode group can generate thermal energy, thereby heating the sample to be tested. This application provides a microfluidic chip that features high energy conversion efficiency, fast heating, and implementation of heating in a specific region.

In addition, the temperature gradient field designed in this application can enable the droplets in the channel of the functional layer to move a low temperature region under action of thermal capillary force, so as to implement precise control of droplets, organisms, polystyrene microspheres, etc.

It should be noted that similar reference numerals and letters indicate similar items in the following drawings. Therefore, once an item is defined in one drawing; the item does not need to be further defined and explained in subsequent drawings.

In descriptions of this application, it should be noted that a direction or a position relationship indicated by terms such as "center", "upper", "lower", "left", "right", "vertical", "horizontal", "inside", or "outside" is a direction or a position relationship shown based on the accompanying drawings, or a direction or a position relationship usually placed when the invented product is used, is merely intended to describe this application and simplify the descriptions, but is not intended to specify or imply that an indicated apparatus or element needs to have a particular direction, needs to be constructed and operated in a particular direction, and therefore shall not be construed as a limitation on this application. In addition, the terms "first", "second", "third"

etc. are merely intended to distinguish between descriptions, and shall not be understood as an indication or implication of relative importance.

In the descriptions of this application, it should be further noted that unless otherwise specified or limited, terms "dispose", "installation", "link", and "connection" shall be understood in a broad sense, for example, may be a fixed connection, or may be a detachable connection or an all-in-one connection; may be a mechanical connection or an electrical connection; or may be a direct connection, an indirect connection through an intermediate medium, or an internal connection of two components. A person of ordinary skill in the art may understand specific meanings of the above-mentioned terms in this application depending on specific situations.

Finally, it should be noted that the foregoing embodiments are merely specific implementations of this application, and are intended for describing the technical solutions in this application but not for limiting this application. The protection scope of this application is not limited thereto. Although this application is described in detail with reference to the foregoing embodiments, persons of ordinary skill in the art should understand that they may still make modifications to the technical solutions described in the foregoing embodiments, or readily figure out variations, or make equivalent replacements to some technical features thereof, within the technical scope disclosed in this application. However, these modifications, variations, or replacements do not make the essence of the corresponding technical solutions depart from the spirit and scope of the technical solutions in the embodiments of this application, and therefore shall fall within the protection scope of this application. Therefore, the protection scope of this application shall be subject to the protection scope of the appended claims.

What is claimed is:

1. A microfluidic chip, comprising: a substrate, and an electrode layer and a functional layer sequentially formed on the substrate, wherein the electrode layer comprises multiple electrode groups arranged in an array;

the multiple electrode groups are configured to: when being activated, convert an electrical signal into an acoustic signal, and transmit the acoustic signal to the functional layer; and the functional layer is configured to: carry a sample to be tested; absorb the acoustic signal emitted by the activated electrode group and convert the acoustic signal into thermal energy; and heat the sample to be tested that is carried at a position corresponding to the activated electrode group;

wherein each electrode group comprises two interdigital electrodes arranged in interdigital fingers, interdigital widths of the two interdigital electrodes of the same electrode group are equal, gaps between adjacent interdigital fingers are equal, and the interdigital width is equal to the gap; and among the multiple electrode groups arranged in an array, interdigital widths of interdigital electrodes in the same column of electrode groups change progressively in a column direction, and interdigital widths of interdigital electrodes in the same row of electrode groups change progressively in a row direction.

2. The microfluidic chip of claim 1, wherein the functional layer comprises a first functional layer and a second functional layer, the first functional layer is located above the electrode layer and is bonded to the substrate, the second functional layer is located above the first functional layer, and a channel for carrying the sample to be tested is disposed between the first functional layer and the second functional layer.

3. The microfluidic chip of claim 1, wherein the functional layer is made from polydimethylsiloxane.

4. The microfluidic chip of claim 1, wherein the substrate is made from any material from lithium niobate, zinc oxide, or aluminum oxide.

5. The microfluidic chip of claim 4, wherein the substrate is made from 128° YX double-sided polished lithium niobate.

6. A microfluidic system, comprising the microfluidic chip of claim 1, a controller and a signal generator, wherein the controller is connected to the signal generator;

the controller is configured to control the signal generator to generate an electrical signal based on a set frequency; and the signal generator is configured to transmit the generated electrical signal to an electrode group for activation when connected to the electrode group, so that the activated electrode group generates an acoustic signal.

7. The microfluidic system of claim 6, wherein electrode group comprises two interdigital electrodes arranged in interdigital fingers, interdigital widths of the two interdigital electrodes of the same electrode group are equal, gaps between adjacent interdigital fingers are equal, and the interdigital width is equal to the gap.

8. The microfluidic system of claim 7, wherein interdigital electrodes of each of the multiple electrode groups arranged in an array have equal interdigital widths.

9. The microfluidic system of claim 7, wherein among the multiple electrode groups arranged in an array, interdigital widths of interdigital electrodes in the same column of electrode groups change progressively in a column direction, and interdigital widths of interdigital electrodes in the same row of electrode groups change progressively in a row direction.

10. The microfluidic system of claim 6, wherein the functional layer comprises a first functional layer and a second functional layer, the first functional layer is located above the electrode layer and is bonded to the substrate, the second functional layer is located above the first functional layer, and a channel for carrying the sample to be tested is disposed between the first functional layer and the second functional layer.

11. The microfluidic system of claim 6, wherein the functional layer is made from polydimethylsiloxane.

12. The microfluidic system of claim 6, wherein the system further comprises a frequency divider, wherein the frequency divider comprises a signal input interface and multiple signal output interfaces, the frequency divider is connected to the signal generator through the signal input interface, and the multiple signal output interfaces are configured to connect to different electrode groups respectively; and the frequency divider is configured to divide the electrical signal generated by the signal generator into electrical signals of different frequencies, and when connected to different electrode groups, transmit the electrical signals of different frequencies through the signal output interfaces to the electrode groups for activation.

13. A microfluidic chip control method, wherein the method is used to control the microfluidic system of claim 6, and comprises:

providing the microfluidic system of claim 6;

controlling, by the controller, the signal generator to generate an electrical signal based on a set frequency; and transmitting, by the signal generator when connected to the electrode group, the generated electrical signal to the electrode group for activation, so that the activated electrode group generates an acoustic signal.

14. The microfluidic chip control method of claim 13, wherein the method further comprises:

transmitting, by the signal generator, the electrical signal to the frequency divider; and dividing, by the frequency divider when connected to an electrode group, the electrical signal into electrical signals of different frequencies, and transmitting the electrical signals to the electrode group for activation.

15. A microfluidic chip preparation method, wherein the method is used to prepare the microfluidic chip of claim 1, the method comprising:

forming a photoresist layer on the substrate;

performing photoetching on the photoresist layer to form a set pattern arranged in an array on the substrate;

performing sputtering on the substrate corresponding to the pattern to form an electrode layer, wherein the formed electrode layer comprises multiple electrode groups arranged in an array, wherein each electrode group comprises two interdigital electrodes arranged in interdigital fingers, interdigital widths of the two interdigital electrodes of the same electrode group are equal, gaps between adjacent interdigital fingers are equal, and the interdigital width is equal to the gap, and among the multiple electrode groups arranged in an array, interdigital widths of interdigital electrodes in the same column of electrode groups change progressively in a column direction, and interdigital widths of interdigital electrodes in the same row of electrode groups change progressively in a row direction, so that the electrode group converts an electrical signal into an acoustic signal when activated, and transmits the acoustic signal to the functional layer; and forming the functional layer on the electrode layer, so that the functional layer carries a sample to be tested, absorbs the acoustic signal emitted by the activated electrode group and converts the acoustic signal into thermal energy, and heats the sample to be tested that is carried at a position corresponding to the activated electrode group.

16. The method of claim 15, wherein the performing photoetching on the photoresist layer to form a set pattern arranged in an array on the substrate comprises:

laying a mask on the photoresist layer for exposure, wherein the mask is the set pattern arranged in an array; and developing and dissolving a non-transparent region in the photoresist layer when the photoresist layer is exposed, to form the set pattern arranged in an array on the substrate.

* * * * *